US009901889B2

(12) United States Patent
Benassi et al.

(10) Patent No.: US 9,901,889 B2
(45) Date of Patent: Feb. 27, 2018

(54) HIGH-PRESSURE HOMOGENIZER

(71) Applicant: GEA MECHANICAL EQUIPMENT ITALIA S.P.A., Parma (IT)

(72) Inventors: Massimiliano Benassi, Fornovo di Taro (IT); Michele Bottioni, Parma (IT)

(73) Assignee: GEA MECHANICAL EQUIPMENT ITALIA S.P.A., Parma (IT)

( * ) Notice: Subject to any disclaimer, the term of this patent is extended or adjusted under 35 U.S.C. 154(b) by 473 days.

(21) Appl. No.: 14/651,449

(22) PCT Filed: Dec. 12, 2013

(86) PCT No.: PCT/IB2013/060873

§ 371 (c)(1),
(2) Date: Jun. 11, 2015

(87) PCT Pub. No.: WO2014/097075

PCT Pub. Date: Jun. 26, 2014

(65) Prior Publication Data

US 2015/0314254 A1 Nov. 5, 2015

(30) Foreign Application Priority Data

Dec. 21, 2012 (IT) ..... PR2012A0089

(51) Int. Cl.
*B01F 15/00* (2006.01)
*B01F 5/06* (2006.01)
(Continued)

(52) U.S. Cl.
CPC ..... *B01F 15/00331* (2013.01); *B01F 3/0807* (2013.01); *B01F 5/06* (2013.01);
(Continued)

(58) Field of Classification Search
CPC .... B01F 15/00331; B01F 3/0807; B01F 5/06; B01F 5/08; B01F 15/00162; B01F 15/0237; B01F 15/042
See application file for complete search history.

(56) References Cited

U.S. PATENT DOCUMENTS 4,666,374 A 5/1987 Nelson
4,773,833 A * 9/1988 Wilkinson ..... B01F 15/0201 137/327

(Continued)

FOREIGN PATENT DOCUMENTS

CN 101988438 A 2/2011
CN 102003365 A 4/2011

(Continued)

*Primary Examiner* — Tony G Soohoo
*Assistant Examiner* — Anshu Bhatia
(74) *Attorney, Agent, or Firm* — Pearne & Gordon LLP

(57) ABSTRACT

A high-pressure homogenizer, comprising: a plurality of pumping pistons (2*a*, 2*b*), for feeding a liquid to be homogenized toward a manifold (6), each piston being associated with a respective oil hydraulic cylinder; a homogenizing valve positioned downstream of said pumping pistons (2*a*, 2*b*); and an electronic system (5) for controlling and regulating said pumping pistons (2*a*, 2*b*), which controls the law of motion of each individual piston (2*a*, 2*b*) independently. Said electronic regulation system (5) is connected to a transducer placed on the manifold (6) to regulate the delivery of oil to the individual cylinders (3*a*, 3*b*) according to the pressure, sensed in the manifold (6), of the liquid to be homogenized pumped by said pistons (2*a*, 2*b*) in order to maintain a stable flow rate and pressure.

7 Claims, 3 Drawing Sheets

(51) Int. Cl.

| | |
|---|---|
| ***B01F 3/08*** | (2006.01) |
| ***F04B 9/10*** | (2006.01) |
| ***F04B 11/00*** | (2006.01) |
| ***B01F 5/08*** | (2006.01) |
| ***B01F 15/02*** | (2006.01) |
| ***B01F 15/04*** | (2006.01) |

(52) U.S. Cl.

CPC ..... *B01F 5/08* (2013.01); *B01F 15/00162* (2013.01); *B01F 15/0237* (2013.01); *B01F 15/042* (2013.01); *F04B 9/10* (2013.01); *F04B 11/0058* (2013.01)

(56) References Cited

U.S. PATENT DOCUMENTS

| | | | |
|---|---|---|---|
| 5,720,551 | A | 2/1998 | Shechter |
| 6,827,479 | B1 | 12/2004 | Xia et al. |
| 8,255,143 | B2 | 8/2012 | Shibata et al. |
| 2002/0196702 | A1 | 12/2002 | Shechter |
| 2011/0029216 | A1 | 2/2011 | Shibata et al. |

FOREIGN PATENT DOCUMENTS

| | | | |
|---|---|---|---|
| DE | 10055986 | A1 | 6/2002 |
| EP | 0212728 | | 3/1987 |
| RU | 2240591 | C2 | 11/2004 |
| SU | 1139487 | A | 2/1985 |
| SU | 1542695 | A2 | 2/1990 |

* cited by examiner

HIGH-PRESSURE HOMOGENIZER

TECHNICAL FIELD

The present invention relates to a high-pressure homogenizer.

BACKGROUND ART

As is well known, in the field of high-pressure fluid treatment, in particular with regard to emulsion micronization applications, stabilization of dispersions and controlled cellular rupture/breakup of a fluid, devices called homogenizers are frequently used. Such devices generally comprise a pump with pistons that move with alternating motion by means of a crankshaft (or camshaft), are synchronous and mutually offset by an angle of 360°/n where n is the number of pumping pistons that move and raise the pressure of the fluid inside the processing part of the machine (the number of pistons generally ranges from one to a maximum of eight pistons).

In particular, homogenizers comprise an adjustable valve (called homogenizing valve), which effects a forced passage of the fluid to be treated from a high pressure area to a low pressure area, or in any case one of lower pressure. The piston pump is located upstream of the valve and is driven by an electric motor which moves the crankshaft.

Interposed between the motor and the pump there is also a reduction gear unit consisting of a pulley system and, where present, a parallel axis or epicyclic reduction gear system.

This kinematic chain serves to convert the rotary motion of the shaft into alternating rectilinear motion, transmitting it rigidly to the pump pistons.

Each piston thus generates a pulsating compression action on the fluid to be treated. The individual piston pulsations are combined together (in relation to the fixed offset introduced by the relative angles between the various cranks of the crankshaft) in a manifold, generating a single resulting pulsation which is directly felt by the homogenizing valve.

Each pumping piston generates, in its own compression chamber, a pulsating pressure ranging from 0 to $p_{max}$ bar, where $p_{max}$=max value the machine is configured for, which may be even greater than 2000 bar.

If the homogenizer is equipped with only one piston, the entire pulsation $0-p_{max}$ is also felt in the same way by the homogenizing valve and by the elements (e.g. transducer) downstream of the pumping valves.

In the case of a plurality of pistons, the amplitude of the resulting pulsations is dampened compared to the case of pumps consisting of a single piston, but is nonetheless perceived downstream of the pump.

Moreover, the crankshaft (or camshaft) is constructed with relative fixed angles between cranks and thus the offset between the pulsations also remains fixed. Consequently, the resulting pulsation, though dampened, is never eliminated but rather always remains constant.

However, the known homogenizers described above exhibit a series of disadvantages, mostly tied to the life cycle of the individual components.

In fact, the pressure and pulsating flow of the fluid results in considerable potential impacts against the moving mechanical parts of the homogenizing valve.

These impacts, affecting the respective mobile element of the valve which works at short axial distances relative to the fixed element, tend to damage the entire structure of the valve, especially in the low peak phases of the pulsations.

Moreover, the pumping action subjects the individual components subjected to pulsations to a fatigue load cycle which results in a considerable reduction in the life cycle of such components.

The wear on the components (which determines the life cycle thereof) is directly proportional to the rpm of the crankshaft (pulsation frequency) and the fluid pumping pressures.

For this reason, at high operating performances (pumping speed and pressure) all of the components cooperating in the compression will have a very short life cycle.

U.S. Pat. No. 6,827,479 discloses a nozzle valve with a fixed geometry and a system for controlling forward travel speeds of the oil hydraulic pistons, wherein the control of the piston travel speeds directly regulates the pressure (without having freedom of action over the latter). In practical terms, once the forward travel speed of the pistons is fixed (law of motion and hence flow rate), the homogenization pressure is automatically fixed and the system substantially has only one degree of freedom.

DISCLOSURE OF THE INVENTION

In this context, the technical task at the basis of the present invention is to propose a homogenizer which overcomes the above-mentioned drawbacks of the prior art.

In particular, it is an object of the present invention to provide a homogenizer which can be used at high pressures while minimizing the mechanical effects that contribute to reducing the life cycle of the individual components cooperating in the pumping operations.

In particular, it is an object of the present invention to provide a homogenizer capable of eliminating the pulsating pumping effect in order to reduce the stresses that result in damage to the homogenizing valve and aforementioned components.

The stated technical task and the specified objects are substantially achieved by the homogenizer of the present invention, comprising the technical features set forth in one or more of the appended claims.

BRIEF DESCRIPTION OF DRAWINGS

Additional features and advantages of the present invention will be more apparent from the approximate, and hence non-restrictive description of a preferred but non-exclusive embodiment of a homogenizer, as illustrated in the appended drawings, in which.

With reference to the appended schematic figures, 1 indicates overall a high-pressure homogenizer.

DETAILED DESCRIPTION OF PREFERRED EMBODIMENTS OF THE INVENTION

The homogenizer comprises a plurality of pumping pistons 2*a*, 2*b*, each of which configured to pump the liquid to be homogenized by feeding it toward a single manifold 6 for collecting the pumped liquid.

It should be noted that hereinafter in the present description reference will be made, purely by way of non-restrictive example, to only two cylinders 3*a*, 3*b*. However, there can be any number of cylinders, and hence of respective pistons, depending on the type of homogenizer, application and flow rate of the liquid to be homogenized.

Positioned in the manifold 6 there is a homogenizing valve (not described or illustrated, as it is of a known type), which receives the liquid to be homogenized. The liquid entering the valve has a pressure value and flow rate determined by the action of the aforementioned pumping pistons 2*a*, 2*b*.

Preferably, each piston 2*a*, 2*b* is associated with a respective oil hydraulic cylinder 3*a*, 3*b*.

Advantageously, the homogenizer 1 comprises a plurality of oil hydraulic cylinders 3*a*, 3*b*, each of which endowed with a respective pumping piston 2*a*, 2*b*.

Each oil hydraulic cylinder 3*a*, 3*b* comprises a respective hydraulic circuit having a proportional valve for feeding oil to the cylinder 3*a*, 3*b*.

The hydraulic circuit makes it possible to govern the law of alternating motion of each cylinder 3*a*, 3*b* and therefore of each respective piston 2*a*, 2*b* through the delivery of oil controlled by the proportional oil valves.

In fact, the proportional valves, which are not described and illustrated since they are of a known type, regulate the pressure and flow rate of oil to the cylinders 3*a*, 3*b* and thus the thrust and travel speed of the respective pistons 2*a*, 2*b*.

The homogenizer 1 further comprises an electronic system 5 for controlling and regulating the pumping pistons 2*a*, 2*b* so as to control the law of motion of each individual piston 2*a*, 2*b* independently.

Figure 2:
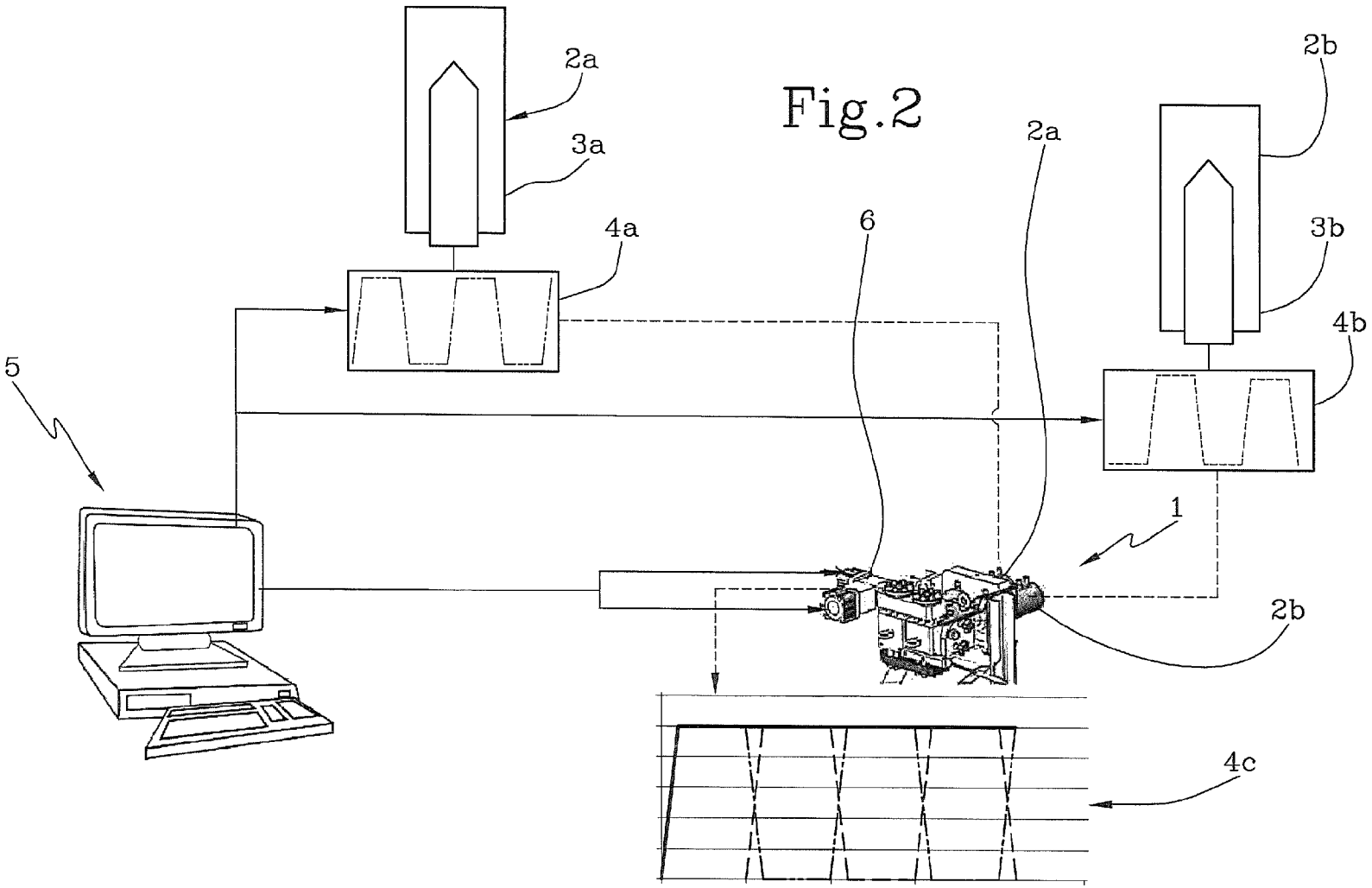
FIG. 2 illustrates a block scheme of the operating cycle of the actions of pumping a fluid to be homogenized.

In particular, as illustrated in the scheme in FIG. 2, the electronic control and regulation system 5 is connected to the proportional valves of the respective oil hydraulic cylinders 3*a*, 3*b* so as to regulate the pressure and flow rate of oil to the individual cylinders (and thus the thrust and travel speed thereof and consequently that of the pumping pistons).

Advantageously, the system 5 is likewise connected to a transducer placed on the manifold 6 in order to verify the pressure values of the liquid to be homogenized which is pumped by the pistons 2*a*, 2*b*. In this manner, the functional parameters of the proportional valve are modified by adjusting the delivery of oil to the individual cylinders 3*a*, 3*b* according to the pressure sensed in the manifold 6, in order to maintain a stable flow rate and pressure.

Being connected to the transducer placed on the manifold 6 in order to verify the pressure values of the liquid to be homogenized which is pumped by the pistons 2*a*, 2*b*, the system 5 makes it possible to modify the functional parameters of the compressed air proportional valve which actuates a pneumatic cylinder that drives the mobile part of the homogenization valve, thus enabling the fixed pressure set point to be adjusted according to the pressure value sensed in the manifold 6, also independently of the flow rate.

Unlike in U.S. Pat. No. 6,827,479, in the present invention homogenization takes place via a homogenizing valve with a variable geometry which is regulated by means of a feedback system controlled by the same software (belonging to the electronic system 5) that also regulates the forward travel speed of the oil hydraulic pumping pistons. Once the travel speed of the pistons is fixed (law of motion, flow rate), there is still freedom to fix the pressure value: the system has two degrees of freedom that can be managed independently (flow rate and pressure), making it possible to have any combination of pressure and flow rate and a stable pattern in the same.

Figure 3:
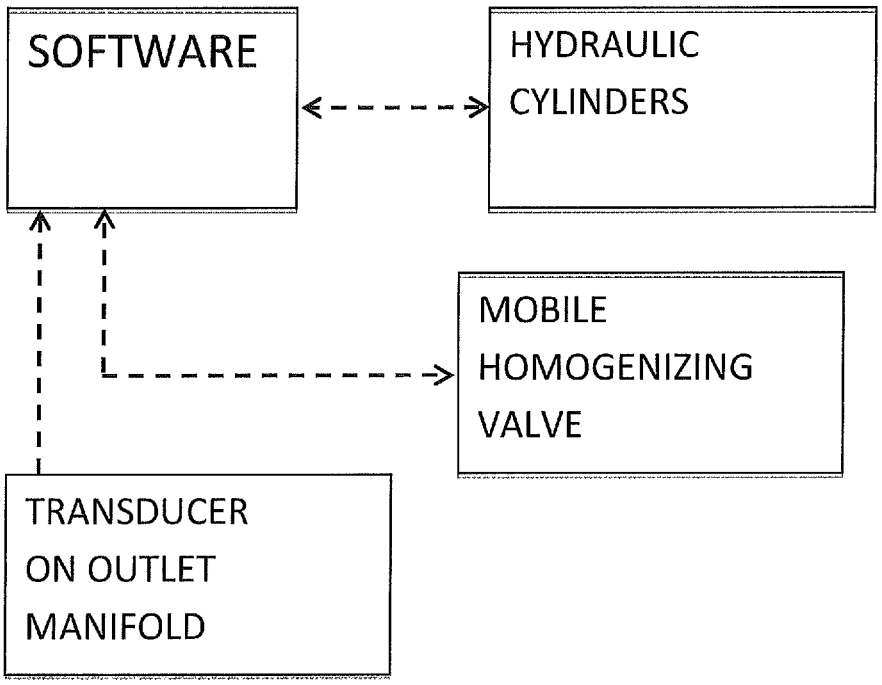
FIG. 3 illustrates a feedback control scheme of the homogenizer.

In U.S. Pat. No. 6,827,479, as the piston speed increases (decreases) the homogenization pressure likewise increases (decreases) respectively, whereas in the present invention there is the innovative scheme in FIG. 3, whereby, when the piston speed increases, it is possible to have an increasing or decreasing homogenization pressure, and when the piston speed decreases, it is possible to have an increasing or decreasing homogenization pressure.

The same type of adjustment can also occur in a completely manual operating mode.

Figure 1:
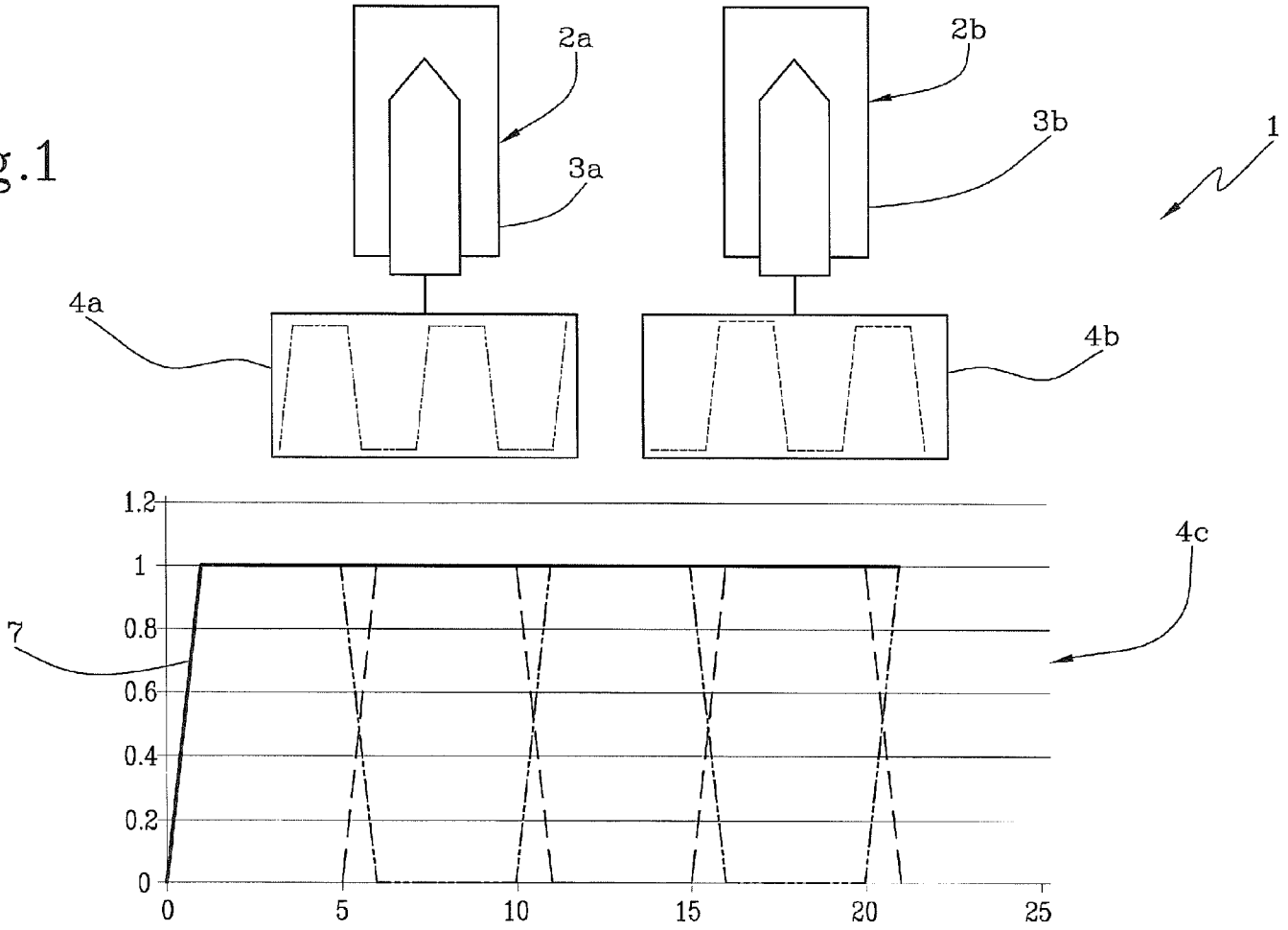
FIG. 1 illustrates a schematic view of an operating scheme of the members which perform the action of pumping a fluid to be homogenized.

With reference to FIG. 1, it should be noted that the individual hydraulic cylinders 3*a*, 3*b* have a pulse pattern as illustrated by the graphs 4*a*, 4*b*. The pattern of the cylinders 3*a*, 3*b* is set in such a way as to stagger the motion of the individual pistons 2*a*, 2*b*. In other words, a first piston 2*a* (which is delivering the product) gradually increases its speed, thereby increasing the flow rate (graph 4*a*). The first piston 2*a* reaches a maximum speed which is maintained for a given period and when it is almost at the end of its stroke begins the descending ramp until reaching zero. In this descending phase, a second piston 3*b* (which sucked back while retracting) simultaneously begins its rising ramp (graph 4*b*) with the same slope as the falling one of the first piston 2*a*.

This phase offset, separately controllable by the electronic system 5 for each cylinder 3*a*, 3*b* (and thus for each piston 2*a*, 2*b*), defines a sum of velocities and hence a constant flow rate as indicated by pattern 7 (graph 4*c*). In the example case described and illustrated above there are only two cylinders 3*a*, 3*b*, which are coordinated so as to define the aforesaid resultant 7. However, in the event of multiple cylinders (more than two) the individual alternating motions of the pistons 2*a*, 2*b* are regulated by the system 5 in such a way as to eliminate the transients between the rising and falling ramps, thereby eliminating the resulting pulsating effect.

The homogenization liquid is therefore pumped toward the homogenizing valve at a constant flow rate, which means a constant homogenization pressure, except during the initial transient, so that one of the preset objectives is reached.

Advantageously, the system 5 directly regulates the individual proportional valves of the hydraulic circuits of each cylinder 3*a*, 3*b* in an independent manner, thus avoiding the problem of having a resulting pulsating motion and a fixed phase offset among the various pistons.

In other words, by creating an appropriate law of motion for each piston and combining it according to a phase offset set in an operating software program of the electronic system 5, one can thus generate a combination of flow rates in the manifold 6 such as to assure a constant sum of the flow rates themselves (resultant 7) and hence an equally constant pressure.

Moreover, it is possible to modify the phase offsets when there is a variation in the viscosity of the liquid product to be homogenized and the inlet pressure of the cylinders 2*a*, 2*b*.

Therefore, several critical mechanical members are preserved, since they are no longer subject to the pulsating action of the pumping operations. In particular, the homogenizing valve receives the liquid to be treated at a constant pressure and flow rate due to the resultant effect 7 of the individual pistons 2*a*, 2*b*.

This advantage is given by the fact that the cylinders 3*a*, 3*b* are oil hydraulic and can therefore be regulated independently by a single operating software program.

Moreover the step-up/step-down transients of the two pistons (graph 4*c*) number only 5-6 per minute, and in any case less than 15 per minute (as a consequence of the reduced piston speeds), very far from the approximately 160 pulsations/minute of a prior art crankshaft, which rotates precisely at about 160 rpm, and they are in any case dampened by the presence, in the virtual cams, of the rising and falling speed ramps of the pistons themselves.

This is important because a constant flow rate and pressure is an ideal situation, but in reality the transients in the piston exchange phases imply the presence of refluxes through the pumping valves; this can cause small deviations from the rated pressure which vary according to the maximum pressure applied and are preferably in the range of 0 to 100 bar. The rated pressure instead remains absolutely constant during the central phases of piston travel.

A very low number of cycles/min extends the lifetime of the components subject to fatigue load cycles and reduces the possibility of damage to the homogenizing valve because the pressure peaks (positive or negative) are reduced and thus the possibility of impact between the fixed and mobile parts is also reduced.

The homogenizer 1 moreover shows to be much more versatile and adaptable to high pressures and to the viscosity of the liquid to be treated. This advantage, too, is given by the possibility of regulating the individual cylinders 3*a*, 3*b* independently.

A further advantage of the present homogenizer, which can work with pressures from 0 to 4000 bar, is the fact that it can be completely remotely controlled.

With the present homogenizer, a homogenization procedure is carried out in which the laws of motion of each piston are created and combined according to a phase offset, which may be set by the user in such a way as to generate a combination of flow rates downstream of the valves/pumping pistons, inside a manifold, which is able to assure a constant sum of said flow rates and thus a constant pressure to the homogenizing valve.

It is possible to adjust the phase offset between the starting of the second piston and the stopping of the first by exploiting appropriate speed ramps, whose beginning and end can be controlled completely via software.

As the max operating pressure and viscosity of the fluid treated vary, the offsets can be modified so as to reduce the amplitude of any pressure peaks during transients in the most appropriate manner.

The present homogenizer is particularly suitable for pressures ranging between 1000 and 4000 bar and has application in many sectors: food, chemical, pharmaceutical, biotechnological and nanoparticles.

The software program used is based on the control and automation of moving axes in combination with two specific control cards (axis control cards).

The axis control card interfaces with the actuator (and thus with the pumping piston) via the proportional valve in order to control its movement and at the same time senses its absolute position by means of a linear encoder positioned inside the piston itself so as to create a command- and feedback-based regulation loop which enables the software program to control the piston's position and movement with extreme precision.

The axis control software program is therefore capable of moving the piston by following virtual cams that are customized in order to optimize the phases of motion reversal by adjusting them beforehand in such a way as to reduce peaks to a minimum.

The software program receives commands from a control panel or via remote signals and actuates the movement of the pistons, modifying the working parameters thereof (advance and design of virtual cams) with the aim of obtaining the most linear operation possible in the presence of fluids with different viscosities and at different pressures.

The invention claimed is:

1. A high-pressure homogenizer, comprising:

a plurality of pumping pistons (2*a*, 2*b*), for feeding a liquid to be homogenized toward a manifold (6); and a homogenizing valve positioned downstream of said pumping pistons (2*a*, 2*b*) so as to receive said liquid to be homogenized which is pumped into the manifold (6);

an electronic system (5) for controlling and regulating said pumping pistons (2*a*, 2*b*), which controls each individual piston (2*a*, 2*b*) independently; wherein said electronic regulation system (5) is connected to a transducer placed on the manifold (6) and enables the delivery of oil to individual cylinders (3*a*, 3*b*) of corresponding pistons (2*a*, 2*b*) to be regulated according to a pressure, sensed in the manifold (6), of the liquid to be homogenized pumped by said pistons (2*a*, 2*b*) in order to maintain a stable flow rate and pressure, making it possible to modify functional parameters of a compressed air proportional valve which actuates a pneumatic cylinder that drives a mobile part of the homogenizing valve, so that the fixed pressure set point can be adjusted according to the pressure value sensed in the manifold (6), also independently of the flow rate, the individual pistons (2*a*, 2*b*) having step-up/step-down transients numbering less than 15 per minute.

2. The homogenizer according to claim 1, wherein each piston is associated with a respective oil hydraulic cylinder (3*a*, 3*b*).

3. The homogenizer according to claim 2, wherein each oil hydraulic cylinder (3*a*, 3*b*) comprises a respective hydraulic circuit having a proportional valve for feeding oil to the cylinder.

4. The homogenizer according to claim 3, wherein said electronic control and regulation system (5) is connected to the proportional valves of the respective oil hydraulic cylinders so as to regulate the pressure and flow of oil to the individual cylinders (3*a*, 3*b*).

5. A process of homogenization in a homogenizer according to claim 1, wherein, after an initial transient, a pressure downstream of the valves/pumping pistons and at the homogenizing valve inlet is nearly constant.

6. The process of homogenization in a homogenizer according to claim 1, wherein each piston is created and combined according to a phase offset, which can be set by a user, in order to generate a combination of flow rates downstream of the valves/pumping pistons, inside the manifold, such as to assure a constant sum of said flow rates and thus a constant pressure to the homogenizing valve.

7. The process of homogenization according to claim 5, wherein the process takes place via a homogenizing valve with a variable geometry which is regulated by means of a feedback system controlled by the electronic control and regulation system (5), which also regulates the forward travel speed of the pumping pistons.

* * * * *